US011484064B2

(12) United States Patent
Watanabe et al.

(10) Patent No.: US 11,484,064 B2
(45) Date of Patent: Nov. 1, 2022

(54) AEROSOL INHALER CARTRIDGE, AEROSOL INHALER, AND AEROSOL INHALER METAL HEATER

(71) Applicant: JAPAN TOBACCO INC., Tokyo (JP)

(72) Inventors: Tomoichi Watanabe, Tokyo (JP); Hidenori Muramoto, Tokyo (JP); Takeshi Akiyama, Tokyo (JP); Mitsuru Okada, Tokyo (JP); Toshiki Kudo, Tokyo (JP); Tomoaki Hongo, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 334 days.

(21) Appl. No.: 16/894,382

(22) Filed: Jun. 5, 2020

(65) Prior Publication Data

US 2020/0297032 A1 Sep. 24, 2020

Related U.S. Application Data

(63) Continuation of application No. PCT/JP2017/043830, filed on Dec. 6, 2017.

(51) Int. Cl.
*A24F 40/46* (2020.01)
*A24F 40/42* (2020.01)
(Continued)

(52) U.S. Cl.
CPC ..... *A24F 40/46* (2020.01); *A24F 40/42* (2020.01); *H05B 3/06* (2013.01); *H05B 3/22* (2013.01);
(Continued)

(58) Field of Classification Search
CPC ..... A24F 40/46; A24F 40/42; A24F 40/10; H05B 3/06; H05B 3/22; H05B 3/42
(Continued)

(56) References Cited

U.S. PATENT DOCUMENTS 4,421,975 A * 12/1983 Stein ..... H05B 3/06 338/217
5,959,254 A * 9/1999 Martin, Sr. ..... H05B 3/16 219/536
(Continued)

FOREIGN PATENT DOCUMENTS

JP 59-97541 A 6/1984
JP 2014-527835 A 10/2014
JP 2017-507647 A 3/2017

OTHER PUBLICATIONS

Japanese Notice of Reasons for Refusal for Japanese Application No. 2019-557922, dated Dec. 15, 2020, with an English translation.
(Continued)

*Primary Examiner* — Alexander Gilman
(74) *Attorney, Agent, or Firm* — Birch, Stewart, Kolasch & Birch, LLP

(57) ABSTRACT

An aerosol inhaler cartridge is provided with a liquid storage unit and a thin metal heater. The metal heater has an obverse face, a reverse face, and a side face joining the obverse face and the reverse face, and is provided, on at least a part of the side face, with a tapered protrusion that protrudes in a tapered shape in a direction different from an imaginary line extending from the obverse face to the reverse face. The tapered protrusion has: a first tapered face formed in an inwardly curving manner extending from an obverse edge part whereat the obverse face and the side face are joined to the tip of the tapered protrusion; and a second tapered face formed in an inwardly curving manner extending from a reverse edge part whereat the reverse face and the side face are joined to the tip of the tapered protrusion.

13 Claims, 16 Drawing Sheets

(51) Int. Cl.

| | |
|---|---|
| ***H05B 3/06*** | (2006.01) |
| ***H05B 3/22*** | (2006.01) |
| ***H05B 3/42*** | (2006.01) |
| *A24F 40/10* | (2020.01) |

(52) U.S. Cl.
CPC ..... *H05B 3/42* (2013.01); *A24F 40/10* (2020.01); *H05B 2203/021* (2013.01)

(58) Field of Classification Search
USPC ..... 131/329
See application file for complete search history.

(56) References Cited

U.S. PATENT DOCUMENTS

| | | | | |
|---|---|---|---|---|
| 9,683,735 | B2 * | 6/2017 | Bowyer | F16L 3/223 |
| 10,046,871 | B2 * | 8/2018 | Marz | A24F 40/30 |
| 10,058,130 | B2 * | 8/2018 | Monsees | A24F 40/46 |
| 10,076,139 | B2 * | 9/2018 | Monsees | A61M 15/06 |
| 10,104,915 | B2 * | 10/2018 | Bowen | A24B 15/167 |
| 11,039,505 | B1 * | 6/2021 | Parker | H05B 3/141 |
| 2011/0042359 | A1 * | 2/2011 | Dimmick | H05B 3/42 29/611 |
| 2014/0305454 | A1 * | 10/2014 | Rinker | A24F 40/485 131/329 |
| 2015/0136156 | A1 * | 5/2015 | Liu | A24F 40/50 131/329 |
| 2016/0353802 | A1 * | 12/2016 | Malgat | G05D 23/2401 |
| 2018/0279672 | A1 * | 10/2018 | Davis | A24F 40/44 |
| 2018/0343917 | A1 * | 12/2018 | Sutton | A24F 40/42 |
| 2020/0084838 | A1 * | 3/2020 | Antonopoulos | H05B 1/0297 |
| 2020/0297032 | A1 * | 9/2020 | Watanabe | H05B 3/22 |
| 2020/0352238 | A1 * | 11/2020 | Simpson | A24F 40/46 |
| 2021/0045568 | A1 * | 2/2021 | Sabeh | A47J 37/0611 |
| 2021/0153549 | A1 * | 5/2021 | Twite | A24F 40/42 |
| 2021/0153569 | A1 * | 5/2021 | Twite | A24F 40/42 |
| 2021/0176828 | A1 * | 6/2021 | Imboden | H05B 3/141 |
| 2021/0307389 | A1 * | 10/2021 | Hourmand | A24F 40/42 |
| 2021/0392950 | A1 * | 12/2021 | Yamada | A24F 40/42 |
| 2022/0160051 | A1 * | 5/2022 | Frake | A24F 15/01 |

OTHER PUBLICATIONS

International Search Report for PCT/JP2017/043830 dated Mar. 6, 2018.

* cited by examiner

AEROSOL INHALER CARTRIDGE, AEROSOL INHALER, AND AEROSOL INHALER METAL HEATER

CROSS-REFERENCE TO RELATED APPLICATIONS

This application is a continuation application of International Application PCT/JP2017/043830 filed on Dec. 6, 2017 and designated the U.S., the entire contents of which are incorporated herein by reference.

FIELD

The present invention relates to an aerosol inhaler cartridge, an aerosol inhaler, and an aerosol inhaler metal heater.

BACKGROUND

An aerosol inhaler that provides generated aerosols through inhaling action of a user is known. Examples of this type of aerosol inhaler include a mode in which an aerosol generating liquid is atomized (aerosolized) by heater-based electric heating with an atomizer. As an aerosol generating liquid, a liquid is known that is used to generate aerosols and that contains glycerin (G), propylene glycol (PG), or the like. Also, in recent years, an atomizing unit that includes a liquid holding member and a sheet heater has been proposed, where the liquid holding member holds an aerosol generating liquid absorbed from a liquid storage tank or the like adapted to store the aerosol generating liquid and the sheet heater is provided on the liquid storage tank (see, for example, Patent document 1 and the like).

CITATION LIST

Patent Document

[Patent document 1] U.S. Patent Application Publication No. 2015/0136156

[Patent document 2] Japanese Translation of PCT International Application Publication No.

SUMMARY

Technical Problem

Here, it is considered that conventional aerosol inhaler metal heaters have room for improvement. The present invention has been made in view of the above circumstances and has an object to provide an aerosol inhaler metal heater improved compared to conventional ones, an aerosol inhaler cartridge equipped with the aerosol inhaler metal heater, and an aerosol inhaler.

Solution to Problem

An aerosol inhaler cartridge according to the present invention comprises a liquid storage unit that stores an aerosol generating liquid, and a metal heater that has a small thickness and atomizes the aerosol generating liquid supplied from the liquid storage unit, in which the metal heater includes a front face, a rear face opposed to the front face, and a side face that connects the front face and the rear face with each other, a tapered protrusion is provided on at least part of the side face, protruding in a tapered manner in a direction different from an imaginary line extending from the front face to the rear face, and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

According to the present invention that adopts the above configuration, since the tapered protrusion is formed on the side face of the metal heater, a sufficient surface area can be secured on the metal heater. More specifically, being equipped with the tapered protrusion, the metal heater according to the present invention can have a larger surface area than a heater with a simply circular or rectangular cross section and without a tapered protrusion when the cross-sectional areas are kept equal. Consequently, because heat generated by the metal heater according to the present invention can be transferred efficiently to the aerosol generating liquid, vaporization of the aerosol generating liquid can be facilitated. That is, atomization of the aerosol generating liquid can be facilitated, and aerosol can be generated more efficiently than before.

Also, in the aerosol inhaler cartridge according to the present invention, a protrusion length dimension of the tapered protrusion from the base end to the tip may be 5% or more to 20% or less, of a thickness dimension of the metal heater.

Also, in the aerosol inhaler cartridge according to the present invention, the tip of the tapered protrusion may be located substantially at a center of the metal heater in a thickness direction.

Also, in the aerosol inhaler cartridge according to the present invention, the metal heater may have a heating unit and an electrode unit formed in one piece, where the heating unit heats the aerosol generating liquid by generating heat when energized.

Also, in the aerosol inhaler cartridge according to the present invention, the metal heater may be a linear heater having a linear shape.

Also, in the aerosol inhaler cartridge according to the present invention, the metal heater may be a plate heater having a plate shape.

Also, in the aerosol inhaler cartridge according to the present invention, a through-hole may be provided penetrating the metal heater in a thickness direction, and the tapered protrusion may be provided on an inside surface of the through-hole.

Also, in the aerosol inhaler cartridge according to the present invention, a plurality of the through-holes may be arranged in the metal heater.

Also, the aerosol inhaler cartridge according to the present invention may further comprise a liquid holding member that is interposed between the liquid storage unit and the metal heater to hold the aerosol generating liquid supplied from the liquid storage unit, in which the metal heater may be provided in contact with the liquid holding member.

Also, in the aerosol inhaler cartridge according to the present invention, the metal heater may be a plate heater having a plate shape with the front face or the rear face being placed in contact with the liquid holding member, and a plurality of through-holes may be arranged in the metal heater, penetrating the metal heater in a thickness direction, with the tapered protrusion being provided on an inside surface of each of the through-holes.

Also, the present invention may be identified as an aerosol inhaler comprising any of the aerosol inhaler cartridges described above. Also, for example, an aerosol inhaler according to the present invention comprises a liquid storage unit that stores an aerosol generating liquid, and a metal heater that has a small thickness and atomizes the aerosol generating liquid supplied from the liquid storage unit, in which the metal heater includes a front face, a rear face opposed to the front face, and a side face that connects the front face and the rear face with each other, a tapered protrusion is provided on at least part of the side face, protruding in a tapered manner in a direction different from an imaginary line extending from the front face to the rear face, and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

Also, the present invention may be identified as an aerosol inhaler metal heater. That is, the present invention is an aerosol inhaler metal heater that has a small thickness and atomizes an aerosol generating liquid, the aerosol inhaler metal heater comprising a front face, a rear face opposed to the front face, and a side face that connects the front face and the rear face with each other, in which a tapered protrusion is provided on at least part of the side face, protruding in a tapered manner in a direction different from an imaginary line extending from the front face to the rear face, and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

Advantageous Effects of Invention

The present invention can provide a technique for an aerosol inhaler heater improved compared to conventional ones.

DESCRIPTION OF EMBODIMENTS

Now, embodiments of an aerosol inhaler cartridge, an aerosol inhaler, and an aerosol inhaler heater in the present invention will be described with reference to the drawings. Also, the sizes, materials, shapes, relative locations, and the like of the components described in the present embodiment are not intended to limit the technical scope of the invention unless otherwise specifically indicated.

First Embodiment

Figure 1:
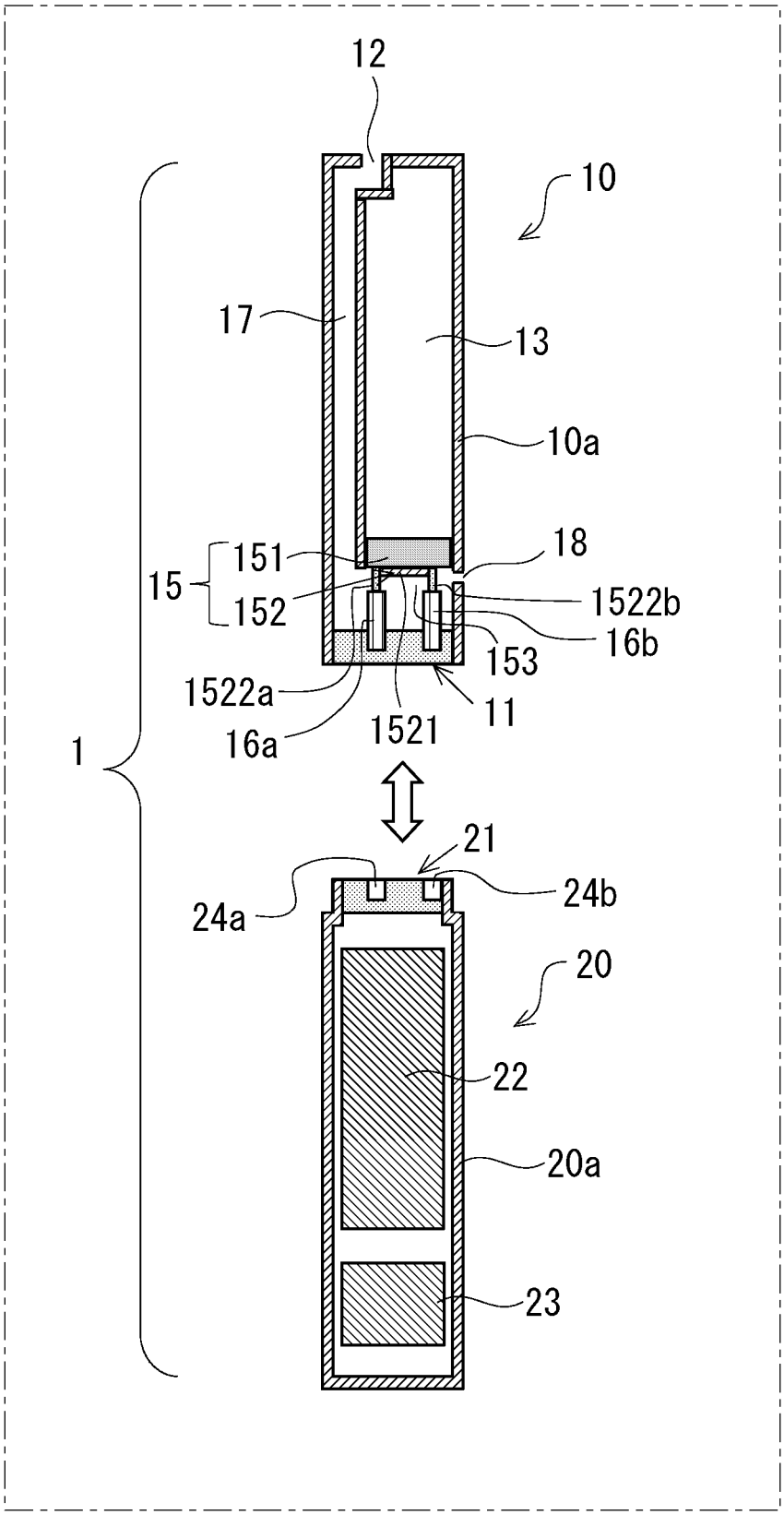
FIG. 1 is a schematic view of an aerosol inhaler according to a first embodiment.

FIG. 1 is a schematic view of an aerosol inhaler 1 according to a first embodiment. The aerosol inhaler 1 includes a cartridge 10 (aerosol inhaler cartridge) and a power supply rod 20, which are coupled together detachably. The cartridge 10 is provided with a first connector 11 at one end. Also, the power supply rod 20 is provided with a second connector 21 at one end. The mechanical and electrical connection between the first connector 11 of the cartridge 10 and the second connector 21 of the power supply rod 20 is achieved, for example, by a fitting method. However, the connection method for the first connector 11 and the second connector 21 is not limited to the fitting method, and various known connection methods including threaded connection are available for use. The cartridge 10 includes a first housing 10*a*. Also, a mouthpiece 12 is provided at an opposite end of the cartridge 10 from the first connector 11. In FIG. 1, the first connector 11 and the second connector 21 are illustrated abstractly.

The power supply rod 20 includes a second housing 20*a*, which houses a battery 22, electronic control unit 23, and the like. For example, the battery 22 is, for example, a lithium ion battery. Also, the battery 22 and the electronic control unit 23 are connected via electric wiring, and power supply from the battery 22 to the electric heater of the cartridge 10 is controlled by the electronic control unit 23. The power supply rod 20 is equipped, for example, with a suction sensor or manual switch (none is illustrated). For example, when the suction sensor detects a draw (puff) taken on the mouthpiece 12 by a user, the user's desire to smoke can be detected.

When the power supply rod 20 is equipped with a suction sensor, the suction sensor is connected with the electronic control unit 23 via electric wiring. Then, when the suction sensor detects a draw (puff) taken on the mouthpiece 12 by the user, the electronic control unit 23 may control and cause the battery 22 to feed electric power to the electric heater of the cartridge 10. As the suction sensor, for example, a pressure sensor, thermal flow meter (such as a MEMS flow sensor), or the like can be used as appropriate, where the pressure sensor detects negative pressure produced by a draw taken by the user. When the power supply rod 20 is equipped with a manual switch, the manual switch is connected with the electronic control unit 23 via electric wiring. Then, when the electronic control unit 23 detects that the manual switch is controlled to be turned on, the electronic control unit 23 controls the battery 22 such that the battery 22 feeds electric power to the electric heater of the cartridge 10.

Next, the cartridge 10 will be described. As described above, the cartridge 10 is provided with the first connector 11 at one end and with the mouthpiece 12 at the other end. In the first housing 10*a* of the cartridge 10, a liquid storage unit 13 is provided, storing an aerosol generating liquid. The first housing 10*a* is, for example, a closed-bottom cylindrical shell, which is open on one side as an open end, and provided with the mouthpiece 12 on the base side. The aerosol generating liquid may be, for example, a liquid mixture of glycerin (G), propylene glycol (PG), a nicotine solution, water, flavoring, and the like. Mixing ratios of ingredients contained in the aerosol generating liquid can be changed as appropriate. Besides, the aerosol generating liquid does not have to contain a nicotine solution. Also, a wick material such as cotton may be housed in the liquid storage unit 13 together with the aerosol generating liquid to hold the aerosol generating liquid impregnated into the wick material.

The cartridge 10 includes an atomizing unit 15 used to atomize the aerosol generating liquid supplied from the liquid storage unit 13 and thereby generate aerosol. In the present embodiment, the liquid storage unit 13 has an open end and a liquid holding member 151 is placed near the open end. As the liquid holding member 151, it is preferable to use an appropriate material capable of holding the aerosol generating liquid absorbed by capillary action. The liquid holding member 151 may be, for example, a wick member made of glass fiber or the like, or may be porous foam, cotton, or the like. In the present embodiment, the liquid holding member 151 is formed into a flat shape. The liquid holding member 151 is interposed between the liquid storage unit 13 and a metal heater 152 described later and is capable of holding the aerosol generating liquid supplied from the liquid storage unit 13, in liquid form.

The atomizing unit 15 includes the liquid holding member 151 described above and the metal heater 152 having a small thickness. The "small thickness" as referred to herein means a form in which a thickness dimension is relatively smaller than a longitudinal dimension along a longitudinal direction X (see FIG. 2A described later) of the metal heater 152, and the shape of a cross section orthogonal to the longitudinal direction X is not specifically limited. Examples of the shape of the metal heater 152 include a linear shape, a strip shape, and a tabular shape (a plate shape), but another shape may be adopted.

Figure 2A:
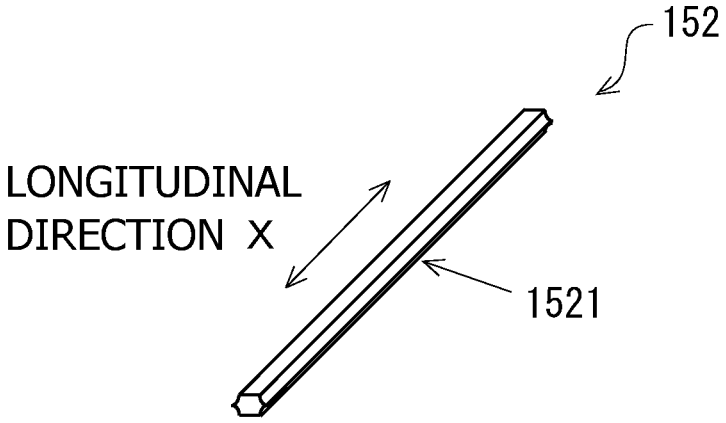
FIG. 2A is a view explaining a metal heater according to the first embodiment.
Figure 2B:
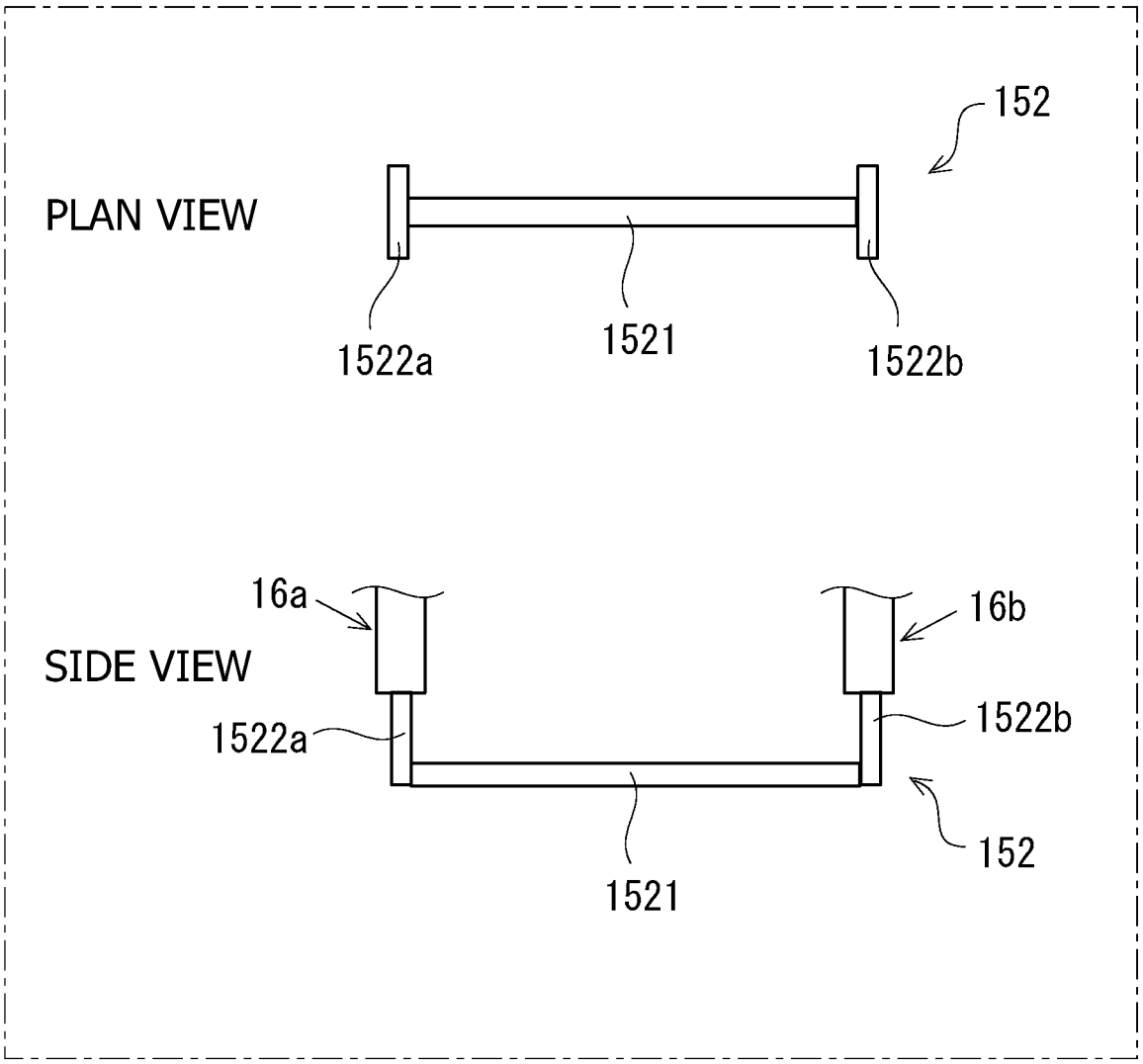
FIG. 2B is a view explaining the metal heater according to the first embodiment.

FIGS. 2A and 2B are views explaining the metal heater 152 according to the first embodiment. The metal heater 152 is an electric heating metallic heater and is a linear heater having a linear heating unit 1521. Needless to say, the linear metal heater 152 corresponds to a heater having a small thickness. FIG. 2A illustrates a schematic perspective view of the heating unit 1521. The upper part of FIG. 2B illustrates a plan view of the metal heater 152, and the lower part illustrates a side view of the metal heater 152. The metal heater 152 includes a pair of electrode units 1522*a* and 1522*b* provided on opposite sides of the heating unit 1521. The metal heater 152 may be made, for example, of stainless steel, nickel-chrome alloy, or iron-chrome-aluminum alloy. The electrode units 1522*a* and 1522*b* are set to be relatively larger in width dimension than the heating unit 1521, and consequently formed as a region relatively lower in electrical resistance than the heating unit 1521.

In the present embodiment, the shapes of the electrode units 1522*a* and 1522*b* are not specifically limited. Also, in the metal heater 152, the positions and sizes of the electrode units 1522*a* and 1522*b* are not specifically limited. Although details of the metal heater 152 will be described later, in the metal heater 152, the heating unit 1521 and the pair of electrode units 1522*a* and 1522*b* are formed of the same material in one piece. The metal heater 152 is configured such that the heating unit 1521 is placed in abutment (contact) with the liquid holding member 151. When the metal heater 152 is energized, the heating unit 1521 generates heat, thereby heating and vaporizing the aerosol generating liquid existing around the heating unit 1521.

Note that male electrode pins 16*a* and 16*b* are joined to the pair of electrode units 1522*a* and 1522*b*, respectively, in the metal heater 152 (see, FIGS. 1, 2B, and the like). The electrode units 1522*a* and 1522*b* and the respective male electrode pins 16*a* and 16*b* may be joined together by welding or caulking, and the joining method is not specifically limited. Also, as illustrated in FIG. 1, the second connector 21 of the power supply rod 20 is provided with female terminals 24*a* and 24*b* that can be fitted onto the male electrode pins 16*a* and 16*b* provided on the side of the first connector 11 of the cartridge 10. For example, when the first connector 11 of the cartridge 10 and the second connector 21 of the power supply rod 20 are fitted and connected together, the male electrode pins 16*a* and 16*b* on the side of the first connector 11 are fitted into the female terminals 24*a* and 24*b* on the side of the second connector 21, thereby electrically connecting the male electrode pins 16*a* and 16*b* with the female terminals 24*a* and 24*b*. Note that the male electrode pins 16*a* and 16*b* are structured to be insulated from each other by an insulating member (not illustrated), and so are the female terminals 24*a* and 24*b*. Note that the female terminals 24*a* and 24*b* of the second connector 21 are connected to a positive terminal and a negative terminal of the battery 22, for example, via non-illustrated lead wires. However, the connection method for the first connector 11 and the second connector 21 is not limited to pin connection, and any of various connection methods can be adopted.

Also, in the first housing 10*a* of the cartridge 10, an atomization cavity 153 is provided near the metal heater 152 of the atomizing unit 15. An air intake 18 for use to take in air from the outside is provided in the first housing 10*a*. When the user takes a draw on the mouthpiece 12, the air taken in from the outside through the air intake 18 of the first housing 10*a* is led into the atomization cavity 153. Then, the aerosol generating liquid vaporized by the metal heater 152 is mixed with the air and then cooled, thereby generating aerosol in the atomization cavity 153. Note that as illustrated in FIG. 1, the atomization cavity 153 is communicated with the mouthpiece 12 through an internal passage 17 formed in the first housing 10*a*. Consequently, the aerosol generated in the atomization cavity 153 of the cartridge 10 is led to the mouthpiece 12 through the internal passage 17 and supplied to the user. Note that the number, positions, sizes, and the like of air intakes 18 provided in the first housing 10*a* are not specifically limited.

Figure 3:
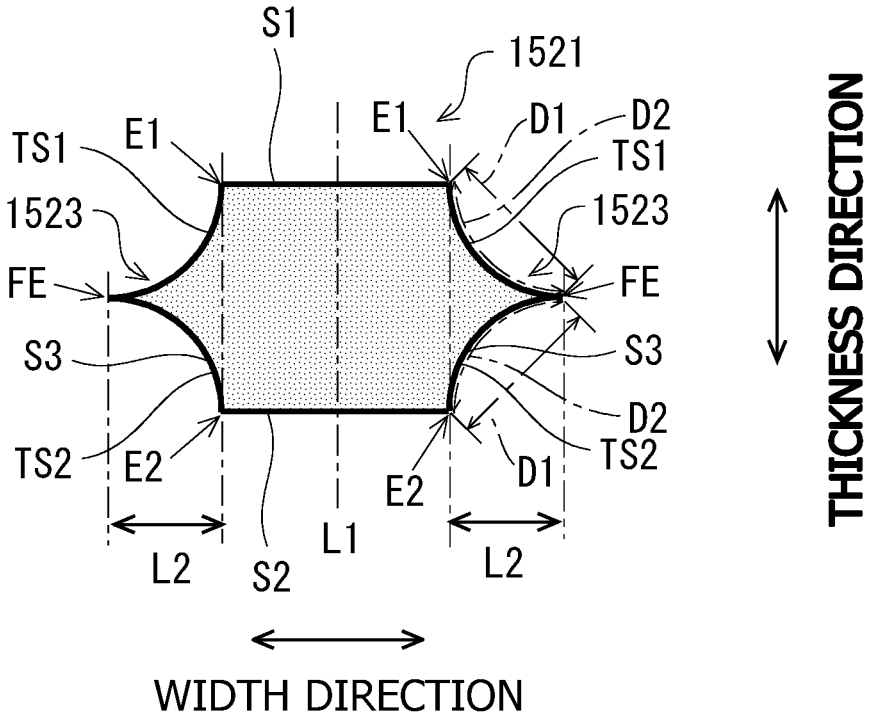
FIG. 3 is a view illustrating a cross section of a heating unit of the metal heater according to the first embodiment.

Next, details of the atomizing unit 15 according to the present embodiment will be described by focusing on a structure of the metal heater 152, in particular. FIG. 3 is a view illustrating a cross section of the heating unit 1521 of the metal heater 152 according to the first embodiment. The cross section of the heating unit 1521 of the metal heater 152 is defined as a section orthogonal to the longitudinal direction indicated by reference sign X in FIG. 2A.

As illustrated in FIG. 3, the heating unit 1521 of the metal heater 152 includes a front face S1, a rear face S2 opposed to the front face S1, and a pair of side faces S3 that connect the front face S1 and the rear face S2 with each other. In the example illustrated in FIG. 3, the front face S1 and the rear face S2 are parallel to each other. Also, tapered protrusions 1523 are provided on at least part of the pair of side faces S3, protruding laterally in a tapered manner. More specifically, the tapered protrusions 1523 protrude in directions different from an imaginary line L1 extending from the front face S1 to the rear face S2. In the mode illustrated in FIG. 3, as an example, the tapered protrusions 1523 protrude in directions orthogonal to the imaginary line L1 extending from the front face S1 to the rear face S2. Hereinafter, the direction in which the front face S1 and the rear face S2 extend will be defined as a "width direction" of the heating unit 1521 and the dimension in the width direction of the heating unit 1521 will be defined as a "width dimension". Also, in the cross section of the heating unit 1521, a direction orthogonal to the width direction will be defined as a "thickness direction" and the dimension in the thickness direction will be defined as a "thickness dimension". Note that the imaginary line L1 extending from the front face S1 to the rear face S2 is parallel to the thickness direction and orthogonal to the width direction of the heating unit 1521. Also, protruding directions of the tapered protrusions 1523 are parallel to the width direction of the heating unit 1521.

Next, details of the tapered protrusions 1523 will be described. Each of the tapered protrusions 1523 is formed by a pair of a first tapered surface TS1 and a second tapered surface TS2 formed into concave curves. The first tapered surface TS1 is formed into a concave curve extending from a front side edge portion E1 serving as a base end toward a tip FE of the tapered protrusion 1523, the front side edge portion E1 being connected with the front face S1 and the side face S3. Also, the second tapered surface TS2 is formed into a concave curve extending from a rear side edge portion E2 serving as a base end toward the tip FE of the tapered protrusion 1523, the rear side edge portion E2 being connected with the rear face S2 and the side face S3. Note that as illustrated in FIG. 3, in the heating unit 1521 of the metal heater 152, preferably the front side edge portions E1 and the rear side edge portions E2 forming the base ends of the tapered protrusions 1523 formed on the respective side faces S3 coincide in position in the width direction of the heating unit 1521.

Figure 4:
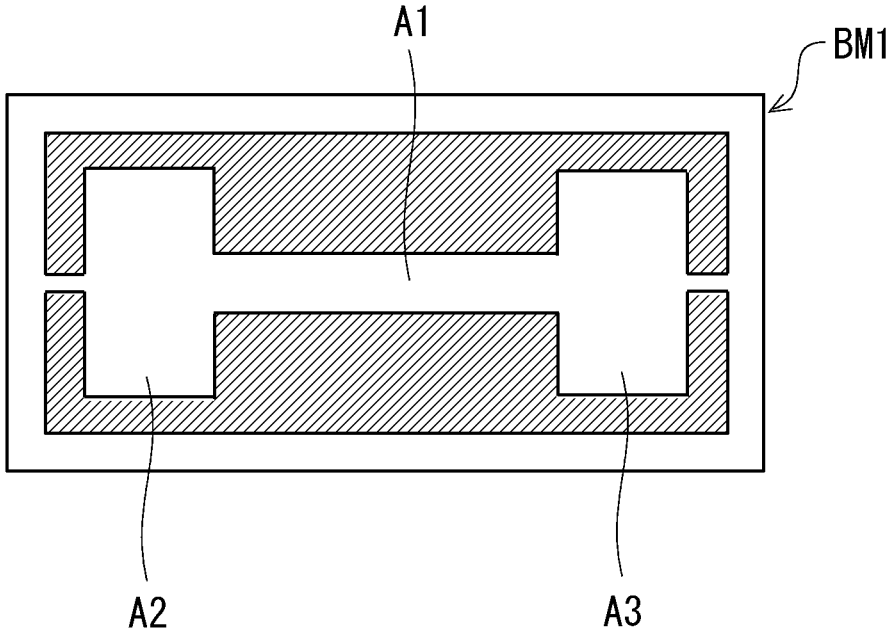
FIG. 4 is a view conceptually explaining a production method for the metal heater according to the first embodiment.

FIG. 4 is a view conceptually explaining a production method for the metal heater 152 according to the first embodiment. Reference sign BM1 denotes a metal substrate used to make a metal heater 152. Here, as an example of producing the metal heater 152, description will be given by citing an example in which the metal heater 152 is made by applying photo-etch processing to the metal substrate BM1. Etching is a surface treatment technique using corrosive action of chemicals or the like, and involves applying a resist process to only necessary part of a material surface to be used and obtaining a desired shape by dissolving unwanted part using an etching reagent (etching solution). The photo-etching is a precision processing technology resulting from a combination of the etching technology described above and photography, i.e., precision photography technology/precision imaging technology, and is a precision chemical processing technology that involves forming a resist of a necessary pattern on a material such as metal using a photoengraving process, removing unwanted part using an etching solution, and thereby partially corroding the material. The hatched part of the metal substrate BM1 is a region in which the metal substrate BM1 is dissolved by the etching solution. Also, in FIG. 4, reference sign A1 denotes a heating unit forming region in which the heating unit 1521 of the metal heater 152 is formed. Also, reference signs A2 and A3 denote electrode unit forming regions in which the electrode units 1522*a* and 1522*b* of the metal heater 152 are formed, respectively.

Next, an etching process of the metal substrate BM1 will be described. First, both faces (front face S1 and rear face S2) of the metal substrate BM1 illustrated in FIG. 4 are coated entirely with a photoresist (step 1: photoresist coating). The photoresist is a photosensitive resin used as a mask to protect the metal substrate BM1 from the etching solution during chemical-machining. Then, of the photoresist applied entirely to both faces of the metal substrate BM1, regions (i.e., the heating unit forming region A1 and electrode unit forming regions A2 and A3 as well as a frame R including an outer frame R1 and connecting portions R2 described later in FIG. 6) excluding a region (hatched region) in which the metal substrate BM1 is to be dissolved by etch processing are covered with a photomask, and by performing an exposure in this state, the photoresist corresponding to the region (hatched region) to be dissolved is exposed (step 2: exposure). Then, the photoresist is removed from the exposed part using a developer (step 3: development). This reveals the front face S1 and the rear face S2 of the region (hatched region) to be dissolved and produces the metal substrate BM1 with the other part (heating unit forming region A1 and electrode unit forming regions A2 and A3) masked by the photoresist.

Figure 5:
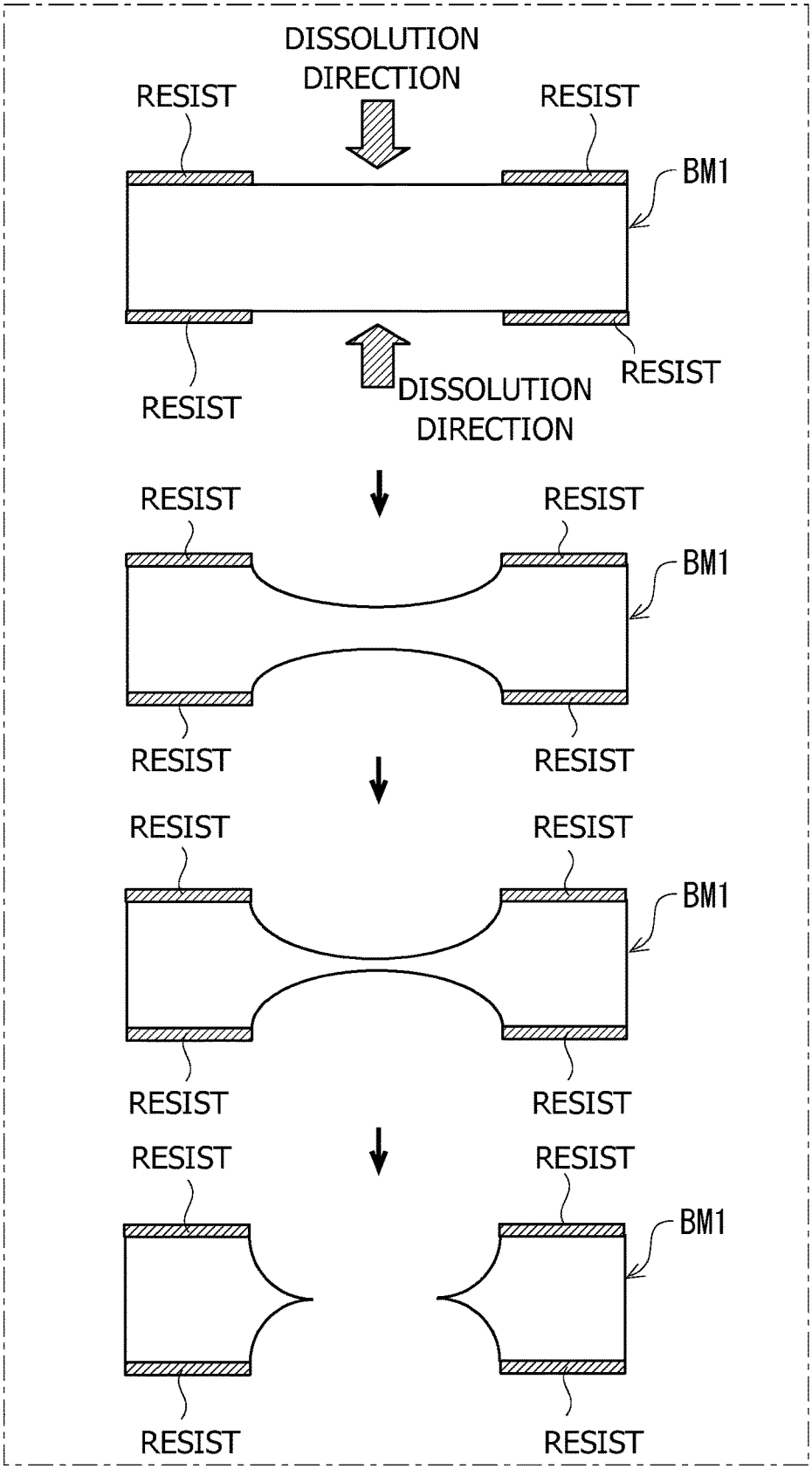
FIG. 5 is a view conceptually explaining a process in which a metal substrate dissolves gradually during double-sided etching.

Next, the metal substrate BM1 (on which the heating unit forming region A1 and electrode unit forming regions A2 and A3 are masked by the photoresist) obtained in step 3 is immersed in the etching solution for a predetermined period of time. The present embodiment adopts double-sided etch processing whereby etch processing is applied to both faces (front face S1 and rear face S2) of the metal substrate BM1. FIG. 5 is a view conceptually explaining a process in which the metal substrate BM1 dissolves gradually during double-sided etching. The hatched arrows in FIG. 5 conceptually indicate dissolution directions when the etching solution dissolves the metal substrate BM1. As illustrated, when double-sided etch processing is applied to the metal substrate BM1, part of the metal substrate BM1 remains in a direction orthogonal to the directions in which the etching solution dissolves the metal substrate BM1. This makes it possible to form the tapered protrusions 1523 described in FIG. 3.

Figure 6:
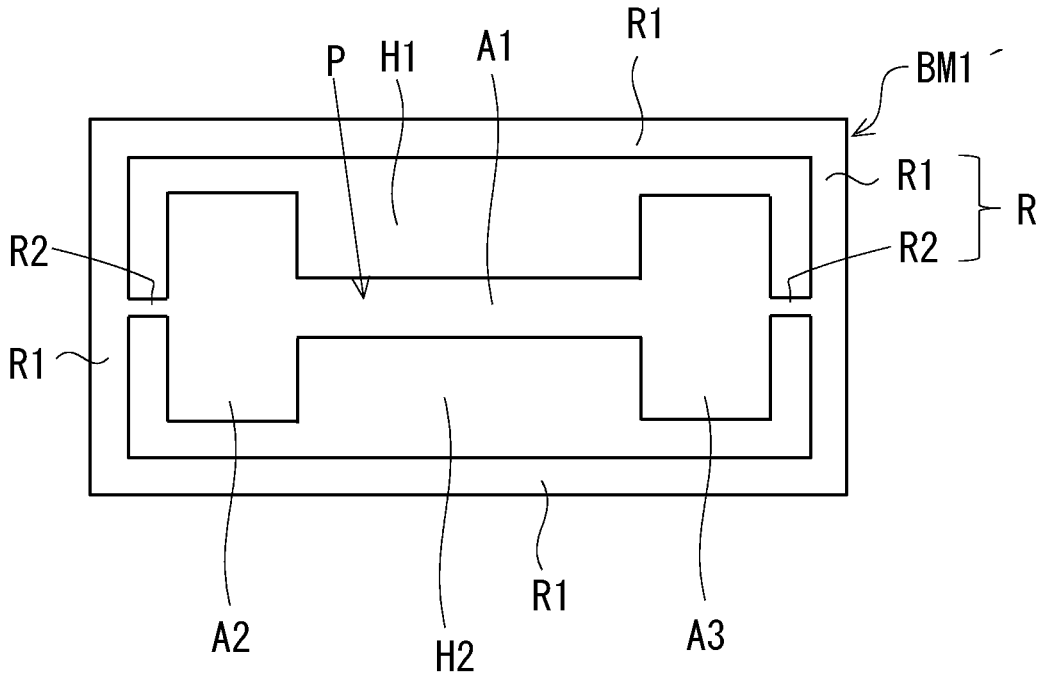
FIG. 6 is a view illustrating a metal substrate after etch processing according to the first embodiment.

When the double-sided etch processing of the metal substrate BM1 is completed, a metal substrate BM1' that has been subjected to the etch processing is obtained as illustrated in FIG. 6. Reference signs H1 and H2 in the figure denote etched holes formed by the etch processing. The tapered protrusions 1523 are formed on edges (in other words, peripheral edges of etched holes H1 and H2) of the metal substrate BM1'. Also, in FIG. 6, reference sign R denotes a frame that is not used as the metal heater 152. In the example illustrated in FIG. 6, the frame R includes an outer frame R1, which is an outer peripheral region of the metal substrate BM1', and connecting portions R2 that connect the outer frame R1 and a heater forming portion P with each other. The heater forming portion P is a region of the metal substrate BM1' which is to become the metal heater 152.

Figure 7:
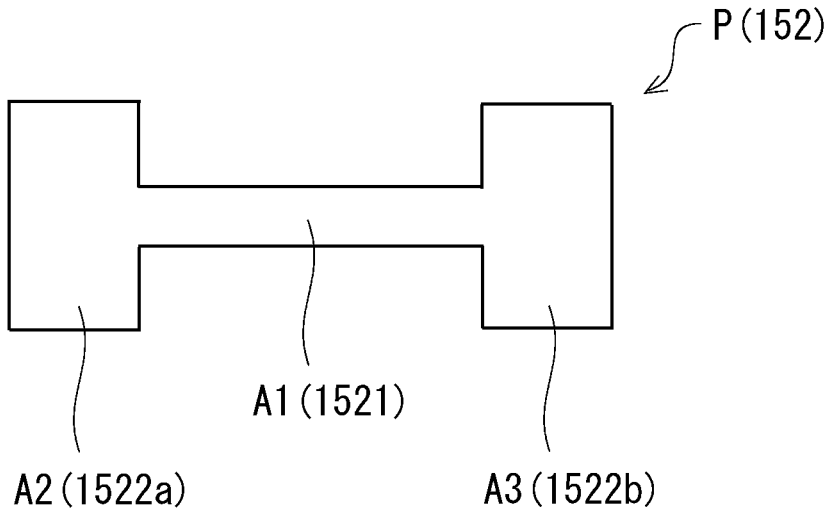
FIG. 7 is a view illustrating a heater forming portion removed from a frame after etch processing of a metal substrate.

In a manufacturing process of the metal heater 152, the heater forming portion P is removed from the connecting portions R2 of the frame R. Therefore, tapered protrusions 1523 such as described above are not provided on side faces of the heater forming portion, where the side faces of the heater forming portion correspond to those parts of the electrode unit forming regions A2 and A3 of the heater forming portion P which are connected to the connecting portions R2. Next, the heater forming portion P (see FIG. 7) obtained in this way undergoes bending such that the pair of electrode units 1522*a* and 1522*b* (electrode unit forming regions A2 and A3) stand up from the heating unit 1521 (heating unit forming region A1). This completes the metal heater 152 such as described with reference to FIGS. 2A, 2B, and 3. Note that as illustrated in FIG. 1, the metal heater 152 is configured such that the heating unit 1521 is placed at a different position from the pair of electrode units 1522*a* and 1522*b* in a longitudinal direction of the cartridge 10 (aerosol inhaler cartridge). Regarding the etching solution for use in producing the metal heater 152, an appropriate one may be adopted according to the metal substrate by selecting, for example, from a ferric chloride solution, a ferric nitrate solution, hydrofluoric acid, nitric acid, and the like as appropriate. Note that although the pair of electrode units 1522*a* and 1522*b* are formed by bending end portions of the heater forming portion P in the above example, this is not restrictive, and the bending described above is not essential in the manufacturing process of the metal heater 152. Also, as described above, the metal heater 152 according to the present embodiment is configured such that some regions on the side faces of the electrode units 1522*a* and 1522*b* are not provided with the tapered protrusions 1523, this is not restrictive, and the tapered protrusions 1523 may be provided on the entire regions on the side faces of the metal heater 152.

Figure 8:
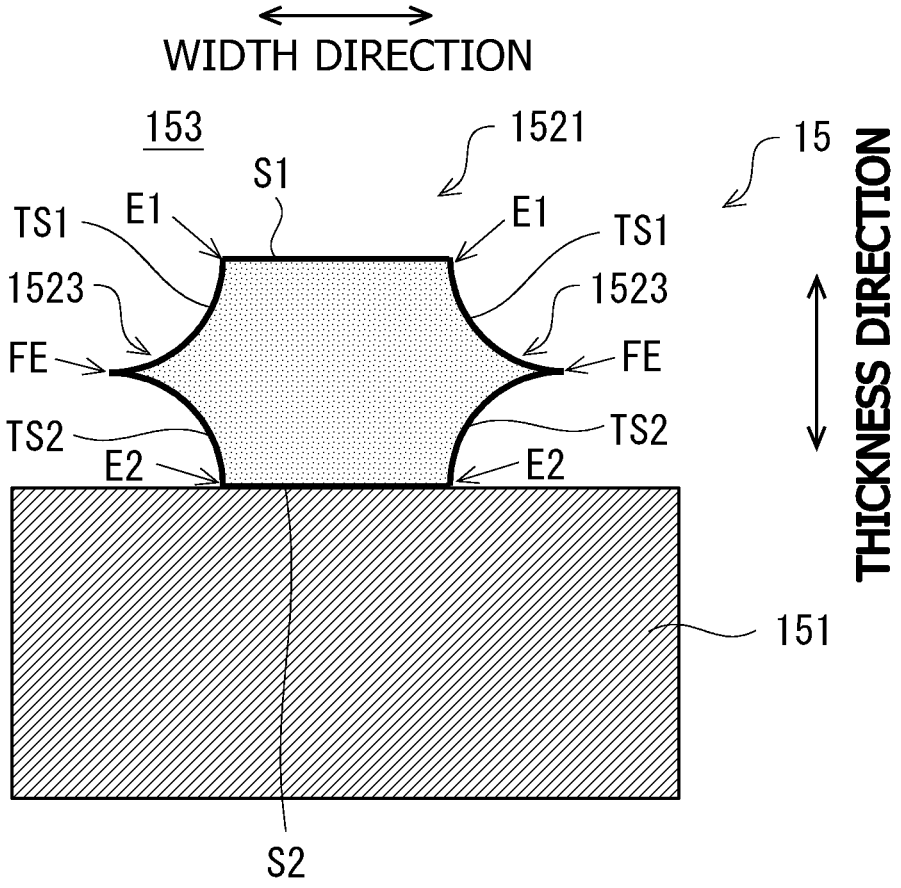
FIG. 8 is a view illustrating by example an installation mode of the heating unit on a liquid holding member of an atomizing unit according to the first embodiment.

FIG. 8 is a view illustrating an installation mode of the heating unit 1521 of the metal heater 152 on the liquid holding member 151 of the atomizing unit 15. In the example illustrated in FIG. 8, the heating unit 1521 is installed on the liquid holding member 151 with the rear face S2 of the heating unit 1521 of the metal heater 152 placed in abutment (contact) with the liquid holding member 151. As described above, since the aerosol generating liquid supplied from the liquid storage unit 13 is absorbed and held in the liquid holding member 151, the aerosol generating liquid exists in abundance around the heating unit 1521. Here, when the user's desire to smoke is detected by the electronic control unit 23 and the battery 22 starts feeding electric power to the metal heater 152 of the cartridge 10, the heating unit 1521 generates heat, thereby vaporizing the aerosol generating liquid. In so doing, because of the tapered protrusions 1523 formed on the side faces S3 the heating unit 1521 according to the present embodiment can secure a sufficient surface area. More specifically, being equipped with the tapered protrusions 1523, the heating unit 1521 can have a larger surface area than a heater with a simply circular or rectangular cross section and without the tapered protrusions 1523 when the cross-sectional areas are kept equal. Consequently, because heat generated by the heating unit 1521 can be transferred efficiently to the aerosol generating liquid, vaporization of the aerosol generating liquid can be facilitated. That is, the metal heater 152 according to the present embodiment can facilitate atomization of the aerosol generating liquid and generate aerosol more efficiently than before.

Furthermore, with the production method for the metal heater 152 according to the present embodiment, the tapered protrusions 1523 are formed on the side faces S3 of the heating unit 1521 through double-sided etching of the metal substrate BM1 for the metal heater 152. The photo-etching, whereby the machining shape is determined by precise photographic images, has the advantage of being able to perform microfabrication with high accuracy. That is, in forming the tapered protrusions 1523 of the heating unit 1521 of the metal heater 152, microfabrication at a level difficult with metal cutting and the like can be performed easily with photo-etching. As the production method for the metal heater 152, various methods are conceivable, and the production method may be implemented, for example, by metal cutting, but the use of photo-etching for the production is preferable. Also, in producing the metal heater 152, the tapered protrusions 1523 of a desired shape can be formed easily, by controlling parameters, including the type of etching solution used for photo-etching, type and thickness of the metal substrate, immersion time of the metal substrate in the etching solution, pressure of the etching solution, and temperature of the etching solution.

An under-mentioned protrusion length dimension L2 (see FIG. 3) of the tapered protrusions 1523 can be decreased for example, by prolonging the immersion time of the metal substrate in the etching solution (more precisely, the immersion time after an opening is formed by dissolution of the hatched region (a region of the metal substrate BM1 from which the photoresist is removed) in FIG. 4 described above). Also, for example, because the speed at which the metal substrate is corroded (dissolved) can be increased by increasing the temperature of the etching solution used for photo-etching, the protrusion length dimension L2 can be reduced when compared by keeping the immersion time in the etching solution constant. Regarding the type of metal substrate, for example, when a corrosion-prone type of metal substrate is used, the protrusion length dimension L2 can be reduced compared to when a relatively corrosion-resistant type of metal substrate is used if the immersion time in the etching solution is kept constant. Also, for example, when the metal substrate is increased in thickness, because a corrosion rate in the width direction tends to decrease, it becomes easy to ensure increases in the protrusion length dimension L2. Note that although in the above embodiment, description has been given of an example in which the tapered protrusions 1523 are formed on the heating unit 1521 of the metal heater 152 by wet etching that uses an etching solution, the tapered protrusions 1523 may be formed on the heating unit 1521 by dry etching.

Also, according to the present embodiment, since the metal heater 152 is produced using photo-etching technology, the heating unit 1521 and the pair of electrode units 1522*a* and 1522*b* can be produced in one piece. This allows shapes and sizes of the electrode units 1522*a* and 1522*b* connected, respectively, to the male electrode pins 16*a* and 16*b* to be set freely, and thereby makes it possible to reduce variations in the heater resistance value resulting from, for example, the joining method, installation area, and the like of the electrode units 1522*a* and 1522*b* with respect to the male electrode pins 16*a* and 16*b*. Besides, since there is no need to weld the electrode units 1522*a* and 1522*b* to the heating unit 1521 as described above, the metal heater 152 of stable quality can be obtained easily. In particular, according to the present embodiment, since the electrode units 1522*a* and 1522*b* (electrode unit forming regions A2 and A3) are connected to the frame R (specifically, the connecting portions R2) of the metal substrate BM1 without connecting the heating unit 1521 (heating unit forming region A1) to the frame R of the metal substrate BM1, variations in the electrical resistance value in the longitudinal direction X of the heating unit 1521 can be reduced. This makes it easy to obtain uniform heating from the heating unit 1521, and thus makes it possible to stabilize atomizing operation. However, the metal heater 152 may be produced by welding the electrode units 1522*a* and 1522*b* to the heating unit 1521.

Note that in the metal heater 152 according to the present embodiment, as illustrated in FIG. 3, the heating unit 1521 of the metal heater 152 is configured such that the tips FE of the tapered protrusions 1523 are located at an approximate center in the thickness direction of the heating unit 1521. Here, placing the tips FE of the tapered protrusions 1523 of the heating unit 1521 at the approximate center in the thickness direction of the heating unit 1521 means placing the tips FE a certain distance away from the front face S1 and the rear face S2. This makes it easy to avoid deformation of the tapered protrusions 1523 even if pressure is exerted only on the tapered protrusions 1523 in abutting the heating unit 1521 of the metal heater 152 against the liquid holding member 151. This makes it possible to reduce variations in the electrical resistance value of the heating unit 1521 among lots.

Also, by placing the tips FE of the tapered protrusions 1523 of the heating unit 1521 at an approximate center in the thickness direction of the heating unit 1521, it is possible to make the shape on the side of the front face S1 and the shape on the side of rear face S2 symmetrical with respect to the tips FE of the tapered protrusions 1523. Consequently, whichever of the front face S1 and the rear face S2 of the heating unit 1521 may be abutted against the liquid holding member 151, substantially equal functions can be exhibited. Also, there is promise of the effect of eliminating the need to make a check in order to distinguish between the front face S1 and the rear face S2 during assembly of the metal heater 152. Note that from the viewpoint of achieving the above effect, preferably the tips FE of the tapered protrusions 1523 of the heating unit 1521 are located within ±10% from a center position in the thickness direction of the heating unit 1521.

Besides, with the production method for the metal heater 152 according to the present embodiment, since the tapered protrusions 1523 are formed on the side faces S3 of the heating unit 1521 through double-sided etching of the metal substrate BM1 for the metal heater 152, the positions of the tips FE of the tapered protrusions 1523 of the heating unit 1521 can be set easily to an approximate center in the thickness direction of the heating unit 1521.

Also, in the metal heater 152 according to the present embodiment, preferably the protrusion length dimension L2 (see FIG. 3) from the base ends (front side edge portion E1 and rear side edge portion E2) of each tapered protrusion 1523 of the heating unit 1521 to the tip FE is in a range of 5% or more to 20% or less of the thickness dimension of the heating unit 1521 of the metal heater 152, and particularly preferably 10% or more to 15% or less. By setting the ratio of the protrusion length dimension L2 of the tapered protrusions 1523 to the thickness dimension of the heating unit 1521 in this way, it is possible to secure a sufficient surface area of the heating unit 1521. This allows the heating unit 1521 to come into contact with a larger amount of aerosol generating liquid, and consequently makes it possible to improve atomization efficiency in the heating unit 1521. Besides, by curbing increases in latent heat used to heat the heating unit 1521 itself, a suitable amount of heat can be generated relative to electric energy.

Also, in the tapered protrusions 1523 of the heating unit 1521 according to the present embodiment, if D1 (see FIG. 3) denotes a line segment length of a straight line joining each front side edge portion E1 (or rear side edge portion E2) and tip FE while D2 (see FIG. 3) denotes an arc length on a first taper surface TS1 (second taper surface TS2) of each tapered protrusion 1523, preferably $1<(D2/D1)<1.29$ is satisfied. That is, preferably the ratio of the arc length D2 to the line segment length D1 is larger than 1 and smaller than 1.29. This makes it possible to increase the surface area in which the tapered protrusions 1523 of the heating unit 1521 can come into contact with the aerosol generating liquid. Note that it is sufficient if the above-mentioned ratio of the arc length D2 to the line segment length D1 is satisfied by at least one of the pair of tapered protrusions 1523 of the heating unit 1521, and this achieves the effect of being able to increase the surface area in which the tapered protrusions 1523 can come into contact with the aerosol generating liquid.

Note that in the heating unit 1521 of the metal heater 152 the front side edge portions E1 and the rear side edge portions E2 of the tapered protrusions 1523 formed, respectively, on the pair of side faces S3 coincide in position in the width direction of the heating unit 1521. Also, the protrusion length dimension L2 (see FIG. 3) of the tapered protrusions 1523 can be adjusted to a desired length by controlling parameters, including the type of metal substrate BM1 used for the heating unit 1521 of the metal heater 152, type and thickness of etching solution, immersion time of the metal substrate BM1 in the etching solution, pressure of the etching solution, and temperature of the etching solution.

Also, from the viewpoint of efficiently atomizing the aerosol generating liquid in the heating unit 1521 of the metal heater 152 as well as from the viewpoint of producing the metal heater 152 by applying photo-etch processing to the metal substrate BM1, suitably dimensions of the heating unit 1521 are set as follows. For example, preferably the thickness dimension of the heating unit 1521 in cross section is 20 μm or more to 120 μm or less, and more preferably 50 μm or more to 120 μm or less. Also, the width dimension of the heating unit 1521 in cross section is 20 μm or more to 120 μm or less, and more preferably 50 μm or more to 120 μm or less. If the thickness or width dimension of the heating unit 1521 is set smaller than 20 μm, accuracy in forming the tapered protrusions 1523 might be reduced, and if the thickness or width dimension is set larger than 120 μm, the latent heat used to heat the heating unit 1521 itself might become excessive, reducing the amount of generated heat relative to electric energy. Thus, by setting the thickness dimension and the width dimension of the heating unit 1521 in cross section to the preferable range described above, it is possible to increase heat generation efficiency of the heating unit 1521. Note that in the cross section of the heating unit 1521, magnitude relationship between the thickness dimension and the width dimension is not specifically limited. Double-sided etch processing can be adopted for production as long as the ratio (aspect ratio) of the thickness dimension to the width dimension of the heating unit 1521 is up to about 1:2.

<Variations>

Figure 9A:
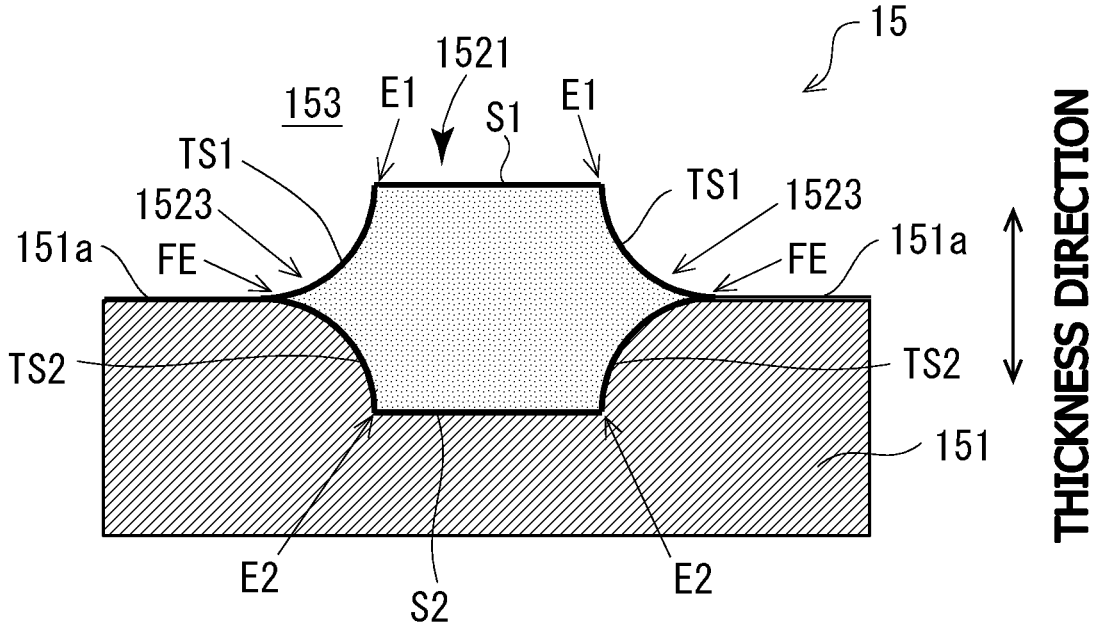
FIG. 9A is a view illustrating by example an installation mode of a heating unit on a liquid holding member of an atomizing unit according to a variation of the first embodiment.

Note that although in the installation example of the metal heater 152 illustrated in FIG. 8, the heating unit 1521 is installed with the rear face S2 of the heating unit 1521 placed in abutment (contact) with the liquid holding member 151, this is not restrictive. The metal heater 152 may be installed with the front face S1 of the heating unit 1521 placed in abutment (contact) with the liquid holding member 151. For example, the metal heater 152 may be installed in a mode in which part of the heating unit 1521 is embedded in the liquid holding member 151. For example, as with a variation illustrated in FIG. 9A, at least one of the metal heater 152 and the liquid holding member 151 may be biased such that the tips FE of the tapered protrusions 1523 of the heating unit 1521 will come into contact with a front face 151*a* of the liquid holding member 151. From the viewpoint of smoothly atomizing the aerosol generating liquid held in the liquid holding member 151, suitably the heating unit 1521 is sunk to such a depth into the liquid holding member 151 that the tips FE of the tapered protrusions 1523 of the heating unit 1521 will come into contact with a front face 151*a* of the liquid holding member 151.

Figure 9B:
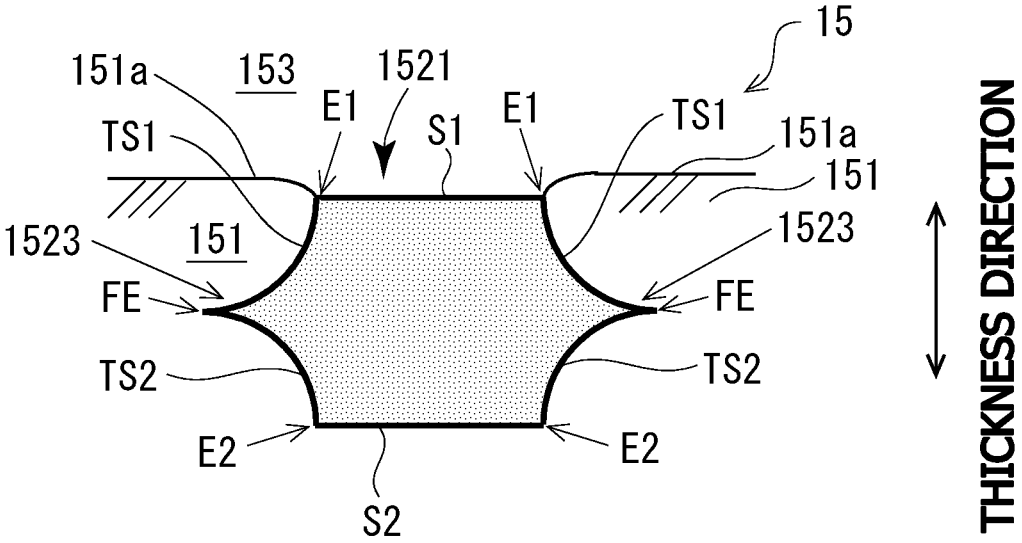
FIG. 9B is a view illustrating by example an installation mode of a heating unit on a liquid holding member of an atomizing unit according to a variation of the first embodiment.

Also, as with a variation illustrated in FIG. 9B, at least one of the metal heater 152 and the liquid holding member 151 may be biased such that the entire heating unit 1521 will be embedded in the liquid holding member 151 with the front face S1 of the heating unit 1521 exposed to the outside. Particularly preferably the metal heater 152 is installed in such a mode from the viewpoint of facilitating atomization of the aerosol generating liquid. In the example illustrated in FIG. 9B, the metal heater 152 is installed in a mode in which the front face S1 of the heating unit 1521 is located at a lower level than the front face 151*a* of the liquid holding member 151. Also, for example, by biasing at least one of the metal heater 152 and the liquid holding member 151, as with a variation illustrated in FIG. 9C, the metal heater 152 may be installed in such a posture as to place the tapered protrusions 1523 provided on the side faces S3 of the heating unit 1521 of the metal heater 152 in abutment (contact) with the liquid holding member 151.

Figure 9C:
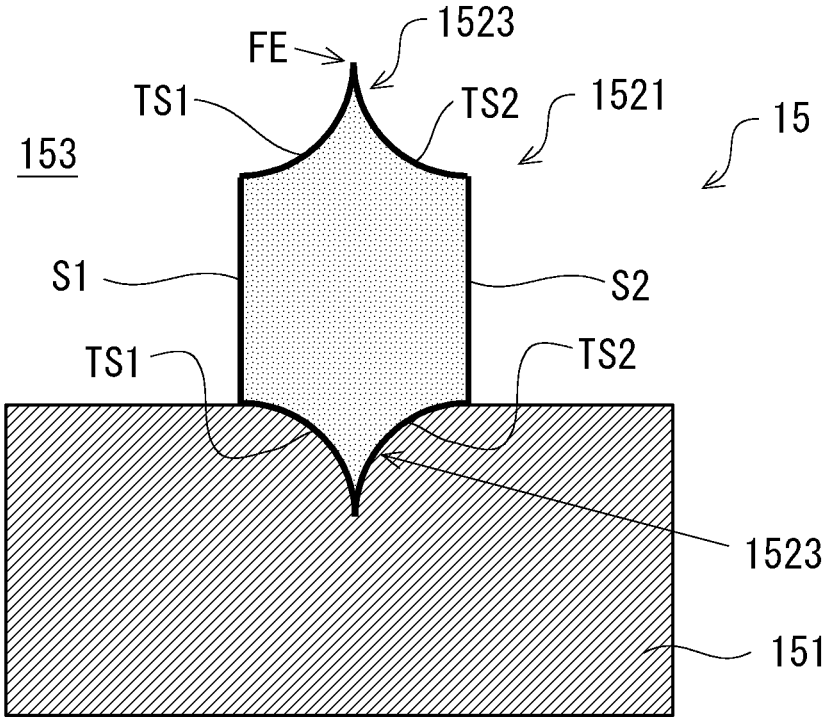
FIG. 9C is a view illustrating by example an installation mode of a heating unit on a liquid holding member of an atomizing unit according to a variation of the first embodiment.

In the installation mode illustrated in FIG. 9C, in assembling the atomizing unit 15 during production of the aerosol inhaler 1, due to an anchoring effect produced when the tapered protrusions 1523 of the heating unit 1521 of the metal heater 152 are caught on the liquid holding member 151, improvement in assembly accuracy of the metal heater 152 can be expected.

Second Embodiment

Figure 10A:
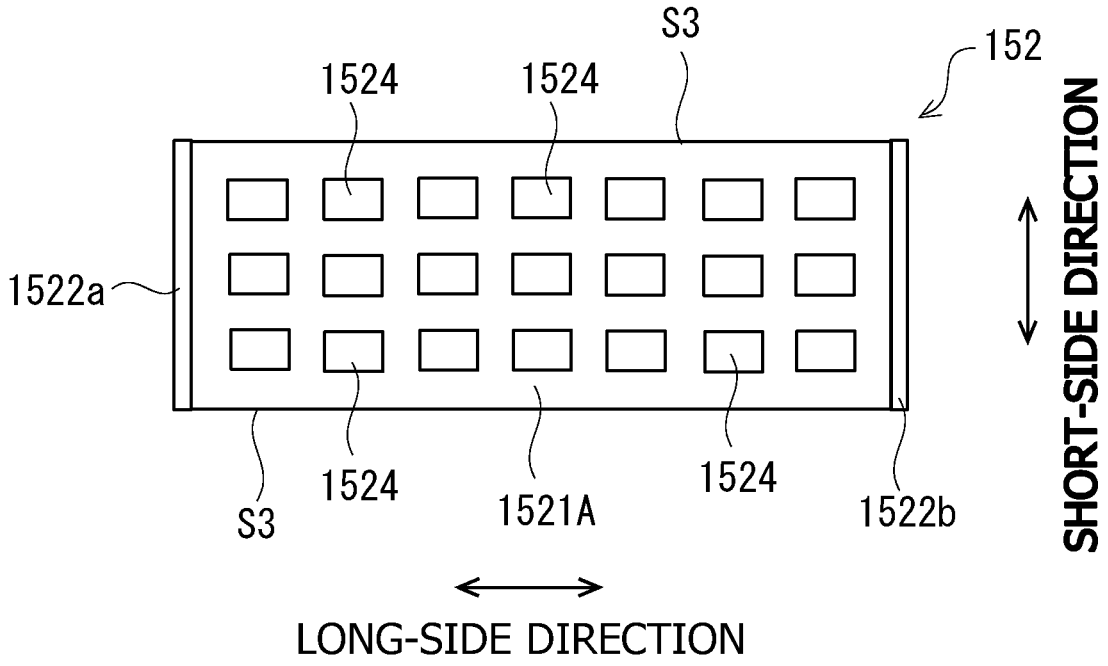
FIG. 10A is a view illustrating a metal heater according to a second embodiment.
Figure 10B:
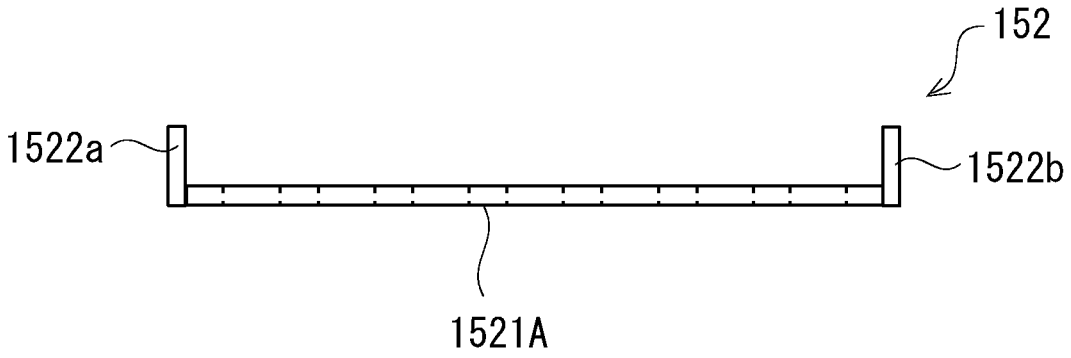
FIG. 10B is a view illustrating the metal heater according to the second embodiment.

Next, a second embodiment will be described. FIGS. 10A and 10B are views illustrating a metal heater 152 according to a second embodiment. FIG. 10A illustrates a plane of the metal heater 152 and FIG. 10B illustrates a side face of the metal heater 152.

The metal heater 152 according to the present embodiment is a plate heater equipped with a heating unit 1521A having a plate shape. In the example illustrated in FIG. 10A, the heating unit 1521A has a substantially rectangular plane and a plurality of through-holes 1524 are provided penetrating the heating unit 1521A in the thickness direction. Hereinafter, a long-side direction on the plane of the heating unit 1521A will be referred to as a longitudinal direction and a short-side direction will be referred to as a width direction. In the example illustrated in FIG. 10A, the through-holes 1524 have a rectangular cross section and the plurality of through-holes 1524 are arranged forming a grid pattern in the plane of the heating unit 1521A.

Figure 11:
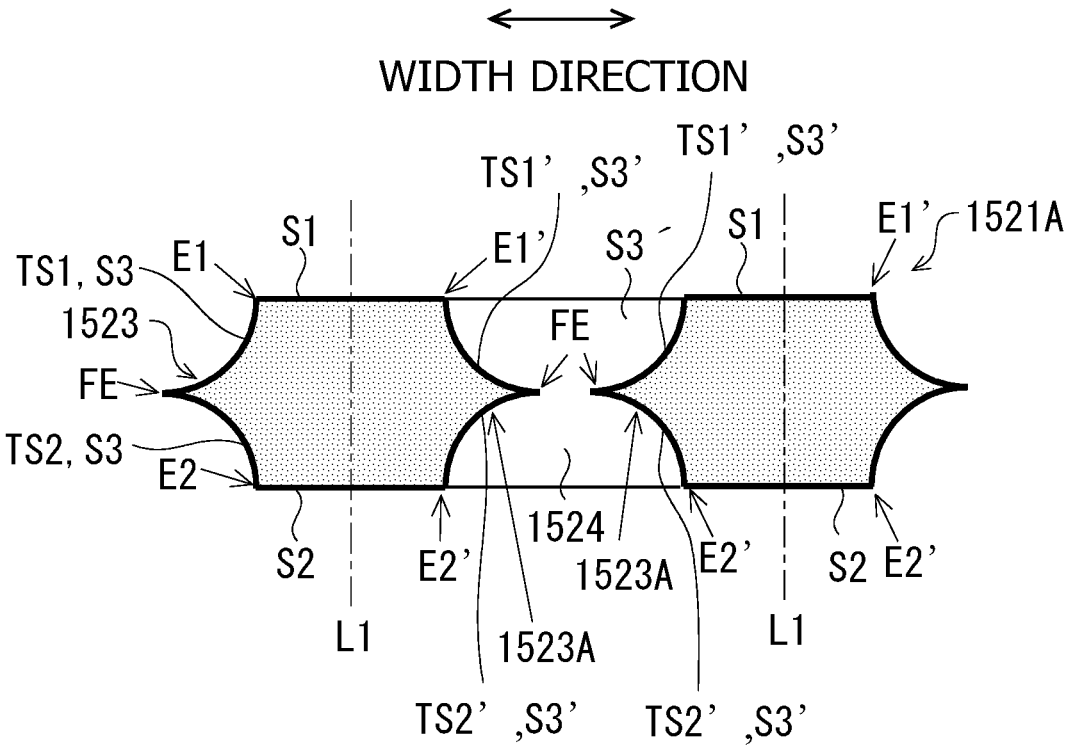
FIG. 11 is a view illustrating part of a cross section of a heating unit according to the second embodiment.

The heating unit 1521A of the metal heater 152 according to the second embodiment includes a front face S1 and a rear face S2 opposed to the front face S1 as with the linear heating unit 1521 according to the first embodiment. Also, the heating unit 1521A includes four side faces S3 configured to connect the front face S1 and the rear face S2 with each other. FIG. 11 is a view illustrating part of a cross section of the heating unit 1521A according to the second embodiment. The cross section of the heating unit 1521A illustrated in FIG. 11 is obtained by cutting the heating unit 1521 along the width direction (short-side direction).

In the heating unit 1521A according to the present embodiment, the tapered protrusion 1523 described in the first embodiment is provided on each side face S3. In the present embodiment, again each of the tapered protrusions 1523 is formed by a pair of a first tapered surface TS1 and a second tapered surface TS2 formed into concave curves and is configured to protrude in a direction orthogonal to the imaginary line L1 extending from the front face S1 to the rear face S2. Besides, the first tapered surface TS1 is formed into a concave curve extending from a front side edge portion E1 serving as a base end toward the tip FE of the tapered protrusion 1523, the front side edge portion E1 being connected with the front face S1 and the side face S3, and the second tapered surface TS2 is formed into a concave curve extending from a rear side edge portion E2 serving as a base end toward the tip FE of the tapered protrusion 1523, the rear side edge portion E2 being connected with the rear face S2 and the side face S3. The tapered protrusions 1523 extend along the four side faces S3 by being formed into an annular shape surrounding an outer periphery of the heating unit 1521A. In the present embodiment, again the tips FE of the tapered protrusions 1523 of the heating unit 1521A are located at an approximate center in the thickness direction of the heating unit 1521A.

Here reference sign S3' in FIG. 11 denotes each inside surface of each through-hole 1524. The inside surfaces S3' of the through-hole 1524 in the heating unit 1521A corresponds to the side face connecting the front face S1 and the rear face S2 with each other. As illustrated in FIG. 11, in the heating unit 1521A according to the present embodiment, tapered protrusions 1523A are provided also on the inside surfaces S3' of the through-hole 1524. Each of the tapered protrusions 1523A is formed by a first tapered surface TS1' and a second tapered surface TS2'. The first tapered surface TS1' is formed into a concave curve extending from a front side edge portion E1' serving as a base end toward the tip FE of the tapered protrusion 1523A, the front side edge portion E1' being connected with the front face S1 of the heating unit 1521A and the inside surface S3', and the second tapered surface TS2' is formed into a concave curve extending from a rear side edge portion E2' serving as a base end toward the tip FE of the tapered protrusion 1523A, the rear side edge portion E2' being connected with the rear face S2' and the inside surface S3'. The tapered protrusions 1523A are formed into an annular shape along the inside surfaces S3' with the tips FE of the tapered protrusions 1523A being located at an approximate center in the thickness direction of the heating unit 1521A.

The metal heater 152 according to the second embodiment can be suitably produced by the double-sided etch processing of the metal substrate BM1 described in the first embodiment. The etching process of the metal substrate BM1 is similar to the process according to the first embodiment, and thus detailed description thereof will be omitted.

Figure 12:
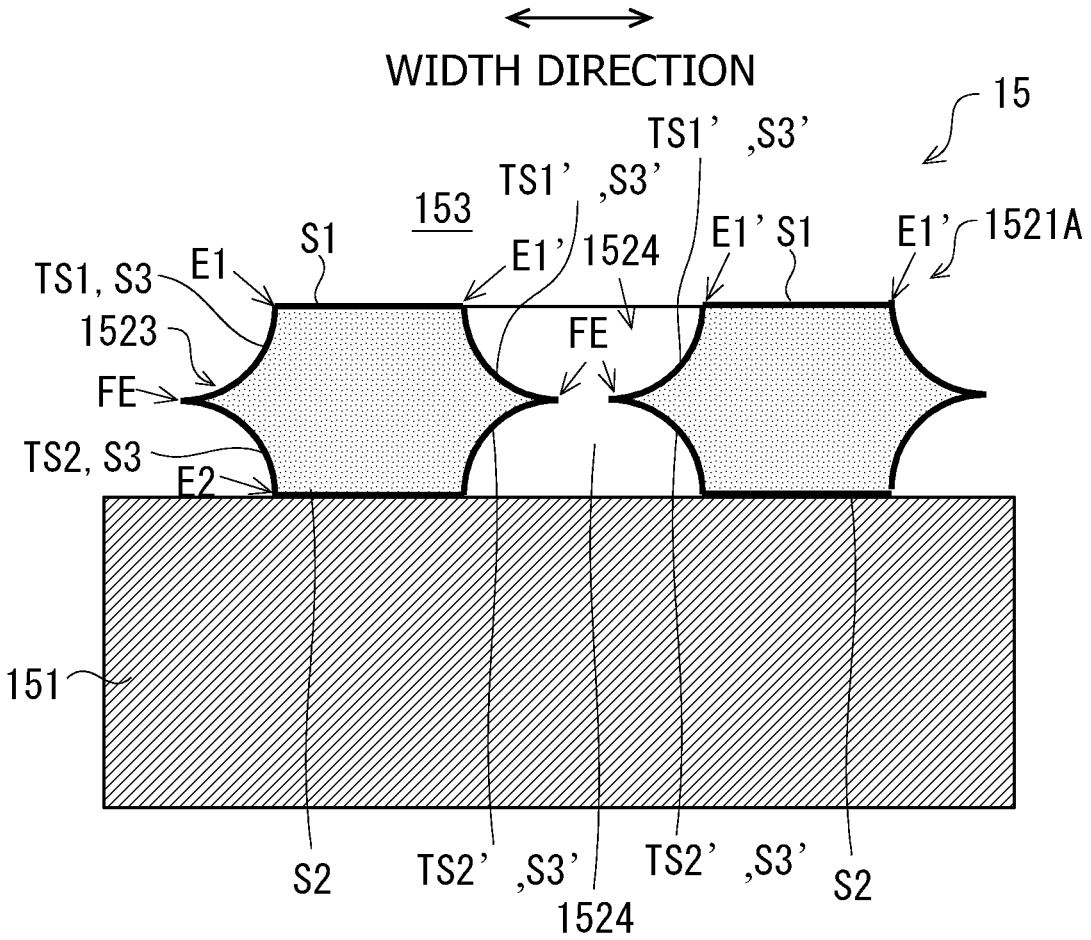
FIG. 12 is a view illustrating a relationship between a liquid holding member and the metal heater in an atomizing unit according to the second embodiment.

FIG. 12 is a view illustrating a relationship between the liquid holding member 151 and the metal heater 152 in the atomizing unit 15 according to the second embodiment. In the example illustrated in FIG. 12, the heating unit 1521A, shaped like a flat plate, is installed with the rear face S2 (or the front face S1) of the heating unit 1521A placed in abutment (contact) with the liquid holding member 151. In the present embodiment again, because the tapered protrusions 1523 are formed on the side faces S3 of the heating unit 1521A and the tapered protrusions 1523A are formed on the inside surfaces S3' of the through-holes 1524, the surface area of the heating unit 1521A can be increased. That is, if the cross-sectional areas are kept equal, compared to when the tapered protrusions 1523 or 1523A are not provided, the surface area of the heating unit 1521A provided with the tapered protrusions 1523 or 1523A can be increased in a relative sense. Consequently, vaporization of the aerosol generating liquid can be facilitated by heat generation of the heating unit 1521A upon energization, allowing aerosol to be generated efficiently.

Furthermore, with the atomizing unit 15 according to the present embodiment, the metal heater 152 is installed in a mode in which the rear face S2 of the tabular (flat) heating unit 1521A is placed in surface contact with the liquid holding member 151 with the through-holes 1524 arranged in a grid pattern. Consequently, the aerosol generating liquid absorbed and held in the liquid holding member 151 can be drawn into the through-holes 1524 in the heating unit 1521A by capillary action. In particular, since the tapered protrusions 1523A are provided in each through-hole 1524 in the heating unit 1521A, the cross-sectional area of an opening in the through-hole 1524 is structured to decrease gradually from the rear side edge portion E2 serving as a base end of the second tapered surface TS2 toward the tip FE of the tapered protrusion 1523A, the second tapered surface TS2 being formed into a concave curve by capillary action. This makes it possible to draw up the aerosol generating liquid smoothly from the liquid holding member 151 toward the tips FE along the second tapered surfaces TS2' of the tapered protrusions 1523A provided in each through-hole 1524 in the heating unit 1521A. That is, when the heating unit 1521A is energized, the aerosol generating liquid can be vaporized smoothly by being drawn up along the second tapered surfaces TS2' of the tapered protrusions 1523A.

Furthermore, in each through-hole 1524 in the heating unit 1521A, the cross-sectional area of the opening in the through-hole 1524 is structured to increase gradually from near the center in the thickness direction where the tips FE of the tapered protrusions 1523A are located to the front side edge portions E1'. This makes it possible to spread the aerosol generating liquid smoothly toward the atomization cavity 153 while the aerosol generating liquid is vaporized by being heated by the second tapered surfaces TS2' of the tapered protrusions 1523A. As a result, the vaporized aerosol generating liquid can be mixed efficiently with air in the atomization cavity 153, facilitating aerosol generation.

Note that in the atomizing unit 15 according to the present embodiment, the metal heater 152 may be installed in a mode in which the front face S1 of the heating unit 1521A is placed in abutment (contact) with the liquid holding member 151, and in this case again, the tapered protrusions 1523A provided in the through-holes 1524 are expected to achieve the effect of facilitating aerosol generation such as described above. Besides, the heating unit 1521A according to the present embodiment may also adopt arrangement in relation to the liquid holding member 151 such as described in the variations illustrated in FIGS. 9A to 9C.

Also, the shape of the through-holes 1524 in the heating unit 1521A is not specifically limited, and may be circular in cross section or polygonal other than quadrangle. Also, in the example illustrated in FIG. 10A, although the plurality of through-holes 1524 are arranged forming a grid pattern in the heating unit 1521A, the arrangement mode of the through-holes 1524 is not specifically limited. For example, the plurality of through-holes 1524 may be arranged irregularly in the heating unit 1521A.

Note that the dimension of the heating unit 1521A of the metal heater 152 according to the second embodiment in the longitudinal direction (long-side direction) is not specifically limited, but a mode in which the longitudinal dimension is 15 mm or less is generally cited.

Whereas preferred embodiments of the present invention have been described above, the aerosol inhaler cartridge, the aerosol inhaler, and the aerosol inhaler metal heater according to the embodiments lend themselves to various changes, improvements, combinations, and the like. For example, whereas in the heating unit 1521 illustrated in the first embodiment (see FIG. 3 and the like) and the heating unit 1521A illustrated in the second embodiment (see FIG. 11 and the like), the tapered protrusions 1523 protrude in directions orthogonal to the imaginary line L1 extending from the front face S1 to the rear face S2, it is sufficient that the tapered protrusions 1523 protrude in directions different from the imaginary line L1, and, for example, the tapered protrusions 1523 may protrude in directions obliquely to the imaginary line L1.

REFERENCE SIGNS LIST

1 . . . Aerosol inhaler
10 . . . Cartridge
11 . . . First connector
12 . . . Mouthpiece
13 . . . Liquid storage unit
15 . . . Atomizing unit
151 . . . Liquid holding member
152 . . . Metal heater
1521 . . . Heating unit
1522*a*, 1522*b* . . . Electrode unit
1523, 1523A . . . Tapered protrusion
1524 . . . Through-hole
TS1, TS1' . . . First tapered surface
TS2, TS2' . . . Second tapered surface

What is claimed is:

1. An aerosol inhaler cartridge comprising:

a liquid storage unit that stores an aerosol generating liquid; and a metal heater that has a small thickness and atomizes the aerosol generating liquid supplied from the liquid storage unit, wherein the metal heater includes a front face, a rear face opposed to the front face, and a side face that connects the front face and the rear face with each other, a tapered protrusion is provided on at least part of the side face, protruding in a tapered manner in a direction different from an imaginary line extending from the front face to the rear face, and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

2. The aerosol inhaler cartridge according to claim 1, wherein a protrusion length dimension of the tapered protrusion from the base end to the tip is 5% or more to 20% or less, of a thickness dimension of the metal heater.

3. The aerosol inhaler cartridge according to claim 1, wherein the tip of the tapered protrusion is located substantially at a center of the metal heater in a thickness direction.

4. The aerosol inhaler cartridge according to claim 1, wherein the metal heater has a heating unit and an electrode unit formed in one piece, where the heating unit heats the aerosol generating liquid by generating heat when energized.

5. The aerosol inhaler cartridge according to claim 1, wherein the metal heater is a linear heater having a linear shape.

6. The aerosol inhaler cartridge according to claim 1, wherein the metal heater is a plate heater having a plate shape.

7. The aerosol inhaler cartridge according to claim 6, wherein a through-hole is provided penetrating the metal heater in a thickness direction, and the tapered protrusion is provided on an inside surface of the through-hole.

8. The aerosol inhaler cartridge according to claim 7, wherein a plurality of the through-holes is arranged in the metal heater.

9. The aerosol inhaler cartridge according to claim 1, further comprising a liquid holding member that is interposed between the liquid storage unit and the metal heater to hold the aerosol generating liquid supplied from the liquid storage unit, wherein the metal heater is provided in contact with the liquid holding member.

10. The aerosol inhaler cartridge according to claim 9, wherein the metal heater is a plate heater having a plate shape with the front face or the rear face being placed in contact with the liquid holding member, and a plurality of through-holes is arranged in the metal heater, penetrating the metal heater in a thickness direction, with the tapered protrusion being provided on an inside surface of each of the through-holes.

11. An aerosol inhaler comprising the aerosol inhaler cartridge according to claim 1.

12. An aerosol inhaler comprising:

a liquid storage unit that stores an aerosol generating liquid; and a metal heater that has a small thickness and atomizes the aerosol generating liquid supplied from the liquid storage unit, wherein the metal heater includes a front face, a rear face opposed to the front face, and a side face that connects the front face and the rear face with each other, a tapered protrusion is provided on at least part of the side face, protruding in a tapered manner in a direction different from an imaginary line extending from the front face to the rear face, and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

13. An aerosol inhaler metal heater that has a small thickness and atomizes an aerosol generating liquid, the aerosol inhaler metal heater comprising a front face, a rear face opposed to the front face, and a side face that connects the front face and the rear face with each other, wherein:

a tapered protrusion is provided on at least part of the side face, protruding in a tapered manner in a direction different from an imaginary line extending from the front face to the rear face; and the tapered protrusion includes a first tapered surface formed into a concave curve extending from a front side edge portion serving as a base end toward a tip of the tapered protrusion, and a second tapered surface formed into a concave curve extending from a rear side edge portion serving as a base end toward the tip of the tapered protrusion, the front side edge portion being connected with the front face and the side face, the rear side edge portion being connected with the rear face and the side face.

* * * * *